US008214999B2

(12) United States Patent
Miles

(10) Patent No.: US 8,214,999 B2
(45) Date of Patent: Jul. 10, 2012

(54) METHOD OF FORMING A MINIATURE, SURFACE MICROSURFACED DIFFERENTIAL MICROPHONE

(75) Inventor: Ronald N. Miles, Newark Valley, NY (US)

(73) Assignee: The Research Foundation of State University of New York, Binghamton, NY (US)

( * ) Notice: Subject to any disclaimer, the term of this patent is extended or adjusted under 35 U.S.C. 154(b) by 0 days.

(21) Appl. No.: 13/198,113

(22) Filed: Aug. 4, 2011

(65) Prior Publication Data

US 2011/0286610 A1 Nov. 24, 2011

Related U.S. Application Data

(62) Division of application No. 11/343,564, filed on Jan. 31, 2006, now Pat. No. 7,992,283.

(51) Int. Cl.
*H04R 31/00* (2006.01)

(52) U.S. Cl. ..... 29/594; 29/592.1; 29/609.1; 216/62; 216/65; 216/66; 381/170; 381/355; 381/358; 381/368; 381/369

(58) Field of Classification Search ..... 29/417, 29/592.1, 594, 595, 609.1; 216/62, 65, 66; 381/170, 313, 355–361, 368, 369
See application file for complete search history.

(56) References Cited

U.S. PATENT DOCUMENTS

| | | | | |
|---|---|---|---|---|
| 4,849,071 | A * | 7/1989 | Evans et al. | 438/53 |
| 5,490,220 | A * | 2/1996 | Loeppert | 381/355 |
| 5,573,679 | A * | 11/1996 | Mitchell et al. | 216/2 |
| 7,053,733 | B2 * | 5/2006 | Yata et al. | 333/195 |
| 7,329,933 | B2 * | 2/2008 | Zhe et al. | 257/419 |

* cited by examiner

*Primary Examiner* — Paul D Kim
(74) *Attorney, Agent, or Firm* — Steven M. Hoffberg; Ostrolenk Faber LLP

(57) ABSTRACT

A differential microphone having a perimeter slit formed around the microphone diaphragm that replaces the backside hole previously required in conventional silicon, micromachined microphones. The differential microphone is formed using silicon fabrication techniques applied only to a single, front face of a silicon wafer. The backside holes of prior art microphones typically require that a secondary machining operation be performed on the rear surface of the silicon wafer during fabrication. This secondary operation adds complexity and cost to the micromachined microphones so fabricated. Comb fingers forming a portion of a capacitive arrangement may be fabricated as part of the differential microphone diaphragm.

21 Claims, 6 Drawing Sheets

METHOD OF FORMING A MINIATURE, SURFACE MICROSURFACED DIFFERENTIAL MICROPHONE

RELATED APPLICATIONS

The present application is related to U.S. Pat. No. 6,788,796 for DIFFERENTIAL MICROPHONE, issued Sep. 7, 2004; and copending U.S. patent application Ser. No. 10/689,189 for ROBUST DIAPHRAGM FOR AN ACOUSTIC DEVICE, filed Oct. 20, 2003, and Ser. No. 11/198,370 for COMB SENSE MICROPHONE, filed Aug. 5, 2005, all of which are incorporated herein by reference. This application is a division of application Ser. No. 11/343,564 filed Jan. 31, 2006, now U.S. Pat. No. 7,992,283, issued Aug. 9, 2011, the entirety of which is expressly incorporated herein by reference.

FUNDED RESEARCH

This invention was made with government support under R01 DC005762 awarded by the National Institutes of Health. The government has certain rights in the invention.

FIELD OF THE INVENTION

The present invention pertains to differential microphones and, more particularly, to a micromachined, differential microphone absent a backside air pressure relief orifice, fabricatable using surface micromachining techniques.

BACKGROUND OF THE INVENTION

In typical micromachined microphones of the prior art, it is generally necessary to maintain a significant volume of air behind the microphone diaphragm in order to prevent the back volume air from impeding the motion of the diaphragm. The air behind the diaphragm acts as a linear spring whose stiffness is inversely proportional to the nominal volume of the air. In order to make this air volume as great as possible, and hence reduce the effective stiffness, a through-hole is normally cut from the backside of the silicon chip. The requirement of this backside hole adds significant complexity and expense to such prior art micromachined microphones. This present invention enables creation of a microphone that does not require a backside hole. Consequently, the inventive microphone may be fabricated using only surface micromachining techniques.

SUMMARY OF THE INVENTION

In accordance with the present invention, there is provided a differential microphone having a perimeter slit formed around the microphone diaphragm. Because the motion of the diaphragm in response to sound does not result in a net compression of the air in the space behind the diaphragm, the use of a very small backing cavity is possible, thereby obviating the need for creating a backside hole. The backside holes of prior art microphones typically require that a secondary machining operation be performed on the silicon chip during fabrication. This secondary operation adds complexity and cost to, and results in lower yields of the microphones so fabricated. Consequently, the microphone of the present invention requires surface machining from only a single side of the silicon chip.

BRIEF DESCRIPTION OF THE DRAWINGS

A complete understanding of the present invention may be obtained by reference to the accompanying drawings, when considered in conjunction with the subsequent, detailed description, in which.

DETAILED DESCRIPTION OF THE PREFERRED EMBODIMENT

The present invention relates to a micromachined differential microphone formed by surface micromachining a single surface of a silicon chip.

The motion of a typical microphone diaphragm results in a fluctuation in the net volume of air in the region behind the diaphragm (i.e., the back volume). The present invention provides a microphone diaphragm designed to rock due to acoustic pressure, and hence does not significantly compress the back volume air.

An analytical model for the acoustic response of the microphone diaphragm including the effects of a slit around the perimeter and the air in the back volume behind the diaphragm has been developed. If the diaphragm is designed to rock about a central pivot, then the back volume and the slit has a negligible effect on the sound-induced response thereof.

Figure 1:
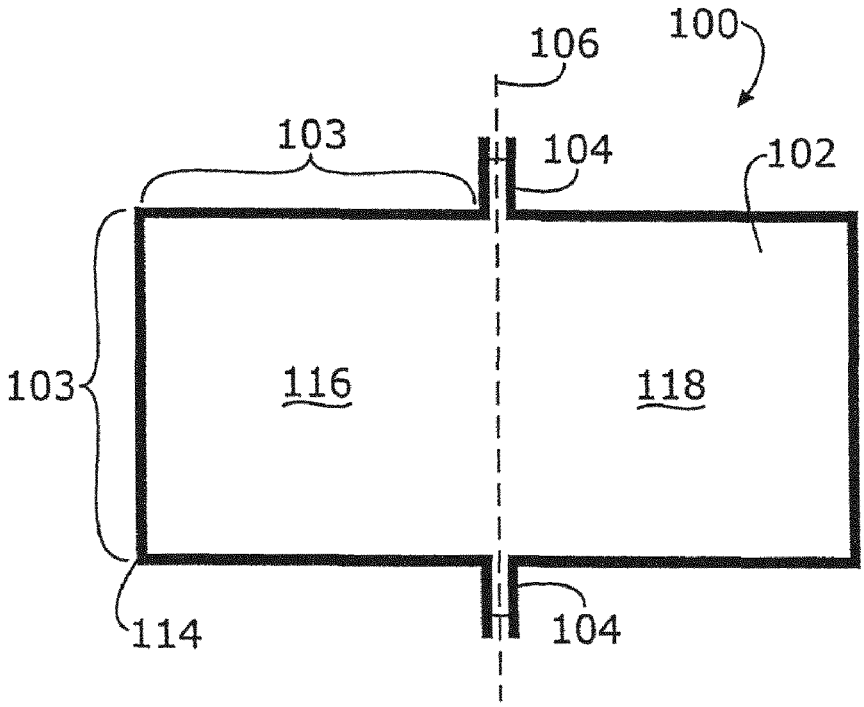
FIG. 1 is a top view of a micromachined microphone diaphragm in accordance with the invention.
Figure 2:
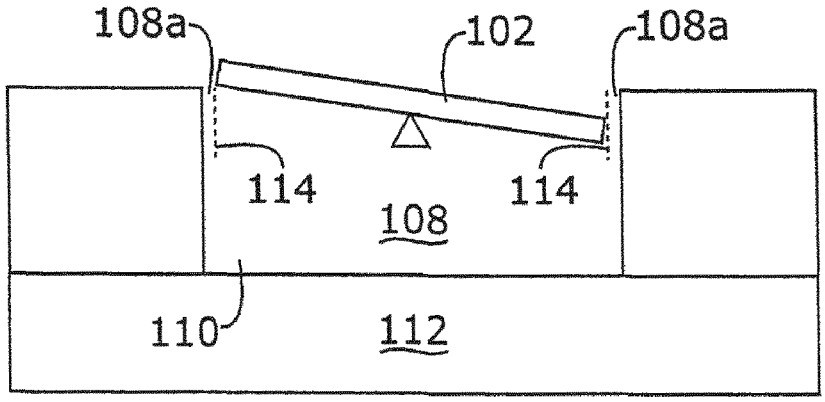
FIG. 2 is a side, sectional, schematic view of a differential microphone of the invention.

Referring first to FIGS. 1 and 2, there are shown, respectively, a top view of a micromachined microphone diaphragm, including a slit around the perimeter of the diaphragm, and a side, sectional, schematic view of a differential microphone in accordance with the invention, generally at reference number 100. A rigid diaphragm 102 is supported by hinges 104 that form a pivot point 106 around which diaphragm 102 may "rock" (i.e., reciprocally rotate). A back volume of air 108 is formed in a cavity 110 formed in the chip substrate 112. A slit 114 is formed between the perimeter 103 of diaphragm 102 and the chip substrate 112.

Diaphragm 102 rotates about the pivot point 106 due to a net moment that results from the difference in the acoustic pressure that is incident on the top surface portions 116, 118 that are separated by the central pivot point 106.

In order to more readily examine the effects of the back volume 108 and the slit 114 around the diaphragm 102, several assumptions are made. It is assumed that the pivot point 106 is centrally located and that diaphragm 102 is designed such that the rocking, or out-of-phase motion of diaphragm 102 is the result of the pressure difference on the two portions 116, 118 of the exterior surface thereof. Because diaphragm 102 is normally designed to respond to the difference in pressure on its two portions 116, 118, microphone 100 is referred to it as a differential microphone. However, in addition to motion induced by pressure differences, it is also possible that diaphragm 102 will be deflected due to the average pressure on its exterior surface. Such pressure causes diaphragm 102 motion in which both portions 116, 118 of the diaphragm 102 separated by the pivot point 106 respond in-phase.

Figure 3:
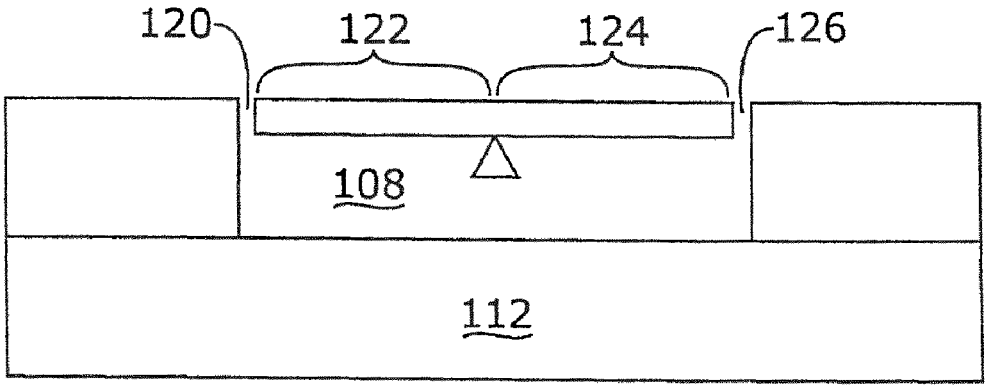
FIGS. 3 and 4 are, respectively, schematic representations of the differential microphone of FIG. 2 as a series of diaphragms without and with an indication of the motion thereof.
Figure 4:
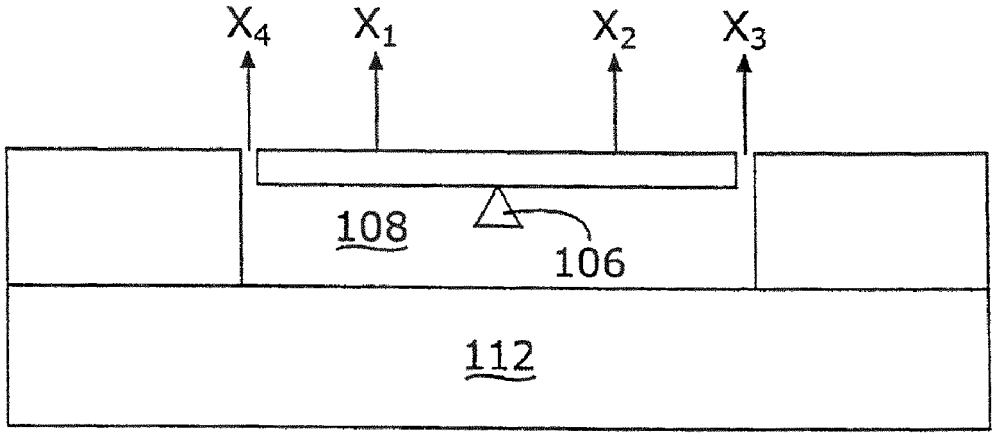

The air 108*a* in the slit 114 around the diaphragm 102 on each portion 116, 118 is assumed to have a mass ma. Consequently, diaphragm 102 responds like an oscillator. Hence, the two portions 116, 118 of the differential microphone 100, along with the two masses of air 108, 108*a* can be represented by a system of diaphragms 120, 122, 124, 126 as shown in FIG. 3. Each of the diaphragms is identified as air 108 (reference number 120), microphone portion 116 (reference number 122), microphone portion 118 (reference number 124), and air 108*a* (reference number 126). The response of each diaphragm is governed by the following equation:

$$m_i\ddot{X}_i+k_iX_i=F_i \tag{1}$$

where: $F_i$ is the net force acting on each diaphragm 120, 122, 124, 126 and $X_4$, $X_1$, $X_2$, and $X_3$, represent the motion of each respective diaphragm 120, 122, 124, 126. As may be seen in FIG. 4, $X_1$ and $X_2$ represent the average motion of each portion 116, 118 of the diaphragm and $X_3$ and $X_4$ represent the motion of the air 108*a* in the slit 114.

A differential microphone without the slit 114 (i.e., a differential microphone of the prior art) can be represented by a two degree of freedom system with rotational response θ and translational response x:

$$m\ddot{x}+kx=F \tag{2a}$$

$$I\ddot{\theta}+k_t\theta=M \tag{2b}$$

where: F is the net applied force, and M is the resulting moment about the pivot point. k and $k_t$ represent the effective transverse mechanical stiffness and the torsional stiffness respectively, of the diaphragm and pivot 102, and 106.

If d is the distance between the centers of each portion 116, 118 of the diaphragm 102, then $X_1$ and $X_2$ may be expressed in terms of the generalized co-ordinates x and θ:

$$X_1 = x + \frac{d}{2}\theta \tag{3}$$

and $$X_2 = x - \frac{d}{2}\theta \Rightarrow x = \frac{X_1 + X_2}{2}$$

and $$\theta = \frac{X_1 - X_2}{2}$$

These relations may also be written in matrix form:

$$\begin{pmatrix} X_1 \\ X_2 \\ X_3 \\ X_4 \end{pmatrix} = \begin{bmatrix} d/2 & 1 & 0 & 0 \\ -d/2 & 1 & 0 & 0 \\ 0 & 0 & 1 & 0 \\ 0 & 0 & 0 & 1 \end{bmatrix} \begin{pmatrix} \theta \\ x \\ X_3 \\ X_4 \end{pmatrix} = [T] \begin{pmatrix} \theta \\ x \\ X_3 \\ X_4 \end{pmatrix} \tag{4}$$

If the dimensions of the air cavity 110 (FIG. 2) behind the diaphragm 102 are much smaller than the wavelength of sound, it may be assumed that the air pressure in the back volume 108 is spatially uniform within the air cavity. The air 108 in this back volume (i.e., cavity 110) then acts as a linear spring. It is necessary to relate the pressure in the back volume air 108 to the displacement of the diaphragm 102 to estimate the stiffness of this spring. If the mass of the air in back volume 108 is assumed to be constant, then the motion of the diaphragm 102 results in a change in the density of the air 108 in cavity 110. The relation between the acoustic, or fluctuating density, $\rho_a$ and the acoustic pressure, p, is the equation of state:

$$p=c^2\rho_a \tag{5}$$

where: c is the speed of sound.

The total density of air is the mass divided by the volume, ρ=M/V. If the volume fluctuates by an amount ΔV due to the motion of diaphragm 102, then the density becomes ρ=M/(V+ΔV)=M/V(1+ΔV/V. For small changes in the volume, this can be expanded in a Taylor's series ⇒=p≈(M/V)(1−ΔV/V). The acoustic fluctuating density is then $\rho_a=-\rho_0\Delta V/V$, where the nominal density is $\rho_0$=M/V. The fluctuating pressure in the volume V due to the fluctuation ΔV, resulting from an outward motion, x, of the diaphragm 102 is then given by:

$$P_d=\rho_0c^2\Delta V/V=-\rho_0c^2Ax/V \tag{6}$$

where: A is half the area of the diaphragm.

This pressure in the back volume 108 exerts a force on the diaphragm 102 given by:

$$F_d=P_dA=\rho_0c^2A^2x/V=-K_dx \tag{7}$$

where: $K_d=\rho_0c^2A^2/V$ is the equivalent spring constant of the air 108 with units of N/m.

The force due to the back volume of air 108 adds to the restoring force from the mechanical stiffness of the diaphragm 102. Including the air in the back volume 108, Equation (2) becomes:

$$m\ddot{x}+kx+k_dx=-PA \tag{8}$$

The negative sign on the right hand side of Equation (8) is attributed to the convention that a positive pressure on the diaphragm's exterior causes a force in the negative direction. From Equation (8), the mechanical sensitivity at frequencies well below the resonant frequency is given by $S_m=A/(k+K_d)$ m/Pa.

The air 108*a* in the slit or vent 114 is forced to move due to the fluctuating pressures both within the space 110 behind the diaphragm 102 and in the external sound field, not shown. Again, it may be assumed that the dimensions of the volume of moving air in the slit 114 to be much smaller than the wavelength of sound and hence it may be approximately represented as a lumped mass ma. An outward displacement, $x_a$, of the air 108*a* in the slit 114 causes a change in the volume of air in the back volume 108. A corresponding pressure similar to Equation (6) is given by:

$$P_{aa}=-\rho_0c^2A_ax_a/V \tag{9}$$

where: $A_a$ is the area of the slit 114 on which the pressure acts.

Again, the pressure due to motion of air 108*a* in the slit 114 applies a restoring force on the mass thereof given by:

$$F_{aa}=P_{aa}A_a=-\rho_0c^2A^2x_a/V=-K_{aa}x_a \tag{10}$$

Since the pressure in the back volume 108 is nearly independent of position within the back volume, a change in the pressure due to motion of the air 108*a* in the slit 114 exerts a force on the diaphragm 102 given by:

$$F_{ad}=P_{aa}A=-\rho_0c^2A_aAx_a/V=-K_{ad}x_a \tag{11}$$

Similarly, the motion of the diaphragm causes a force on the mass of air 108 given by:

$$F_{da}=P_dA_a=-\rho_0c^2AA_ax/V=-K_{da}x \tag{12}$$

From Equations (6), (10), (11) and (12), it may be seen that the forces add to the restoring forces due to mechanical stiffness in the system of Equation (1). Hence the volume change due to motion of each co-ordinate is given by $\Delta V_i = A_i X_i$ and $F_i = PA_i$. Now, the total pressure due to the motion of all co-ordinates is given by:

$$P_{tot} = -\frac{\rho_0 c^2}{V}(A_1X_1 + A_2X_2 + A_3X_3 + A_4X_4) = -\frac{\rho_0 c^2}{V}\sum_i A_iX_i \tag{13}$$

The force due to this pressure on the jth coordinate in this model (indicating the motions of 120, 122, 124, and 126 in FIG. 3) is then given by:

$$F_j = P_{tot}A_j = \left(-\frac{\rho_0 c^2}{V}\sum_i A_iX_i\right)A_j = -\sum_i K_{ij}X_i \tag{14}$$

where:

$$K_{ij} = -\frac{\rho_0 c^2}{V}A_iA_j.$$

Equation (14) may be written as:

$$\begin{pmatrix} F_1 \\ F_2 \\ F_3 \\ F_4 \end{pmatrix} = -\begin{bmatrix} K_{11} & K_{12} & K_{13} & K_{14} \\ K_{21} & K_{22} & K_{23} & K_{24} \\ K_{31} & K_{32} & K_{33} & K_{34} \\ K_{41} & K_{42} & K_{43} & K_{44} \end{bmatrix}\begin{pmatrix} X_1 \\ X_2 \\ X_3 \\ X_4 \end{pmatrix} \tag{15}$$

Combining Equations (4) and (15), in terms of the coordinates θ and x of the differential microphone, the force is represented as:

$$\begin{pmatrix} F_1 \\ F_2 \\ F_3 \\ F_4 \end{pmatrix} = -\begin{bmatrix} K_{11} & K_{12} & K_{13} & K_{14} \\ K_{21} & K_{22} & K_{23} & K_{24} \\ K_{31} & K_{32} & K_{33} & K_{34} \\ K_{41} & K_{42} & K_{43} & K_{44} \end{bmatrix}[T]\begin{pmatrix} \theta \\ x \\ X_3 \\ X_4 \end{pmatrix} \tag{16}$$

Equation (16) may be rewritten in terms of the average force acting on the differential microphone 100 and the net moment acting on the pivot point 106. This is given by:

$$F = \frac{F_1 + F_2}{2}$$

and $$M = (F_1 - F_2)\frac{d}{2} \Rightarrow F_1 = F + \frac{M}{d}$$

and $$F_2 = F - \frac{M}{d}$$

What follows therefrom is:

$$\begin{pmatrix} M \\ F \\ F_3 \\ F_4 \end{pmatrix} = \begin{bmatrix} d/2 & -d/2 & 0 & 0 \\ 1/2 & 1/2 & 0 & 0 \\ 0 & 0 & 1 & 0 \\ 0 & 0 & 0 & 1 \end{bmatrix}\begin{pmatrix} F_1 \\ F_2 \\ F_3 \\ F_4 \end{pmatrix} \tag{17}$$

$$\Rightarrow \begin{pmatrix} M \\ F \\ F_3 \\ F_4 \end{pmatrix} = -\begin{bmatrix} d/2 & -d/2 & 0 & 0 \\ 1/2 & 1/2 & 0 & 0 \\ 0 & 0 & 1 & 0 \\ 0 & 0 & 0 & 1 \end{bmatrix}\begin{bmatrix} K_{11} & K_{12} & K_{13} & K_{14} \\ K_{21} & K_{22} & K_{23} & K_{24} \\ K_{31} & K_{32} & K_{33} & K_{34} \\ K_{41} & K_{42} & K_{43} & K_{44} \end{bmatrix}[T]\begin{pmatrix} \theta \\ x \\ X_3 \\ X_4 \end{pmatrix}$$

$$\Rightarrow \begin{pmatrix} M \\ F \\ F_3 \\ F_4 \end{pmatrix} = -[K']\begin{pmatrix} \theta \\ x \\ X_3 \\ X_4 \end{pmatrix}$$

Hence, the system of equations:

$$\begin{bmatrix} I & 0 & 0 & 0 \\ 0 & m & 0 & 0 \\ 0 & 0 & m_a & 0 \\ 0 & 0 & 0 & m_a \end{bmatrix}\begin{pmatrix} \ddot{\theta} \\ \ddot{x} \\ \ddot{X}_3 \\ \ddot{X}_4 \end{pmatrix} + \begin{bmatrix} k_t & 0 & 0 & 0 \\ 0 & k & 0 & 0 \\ 0 & 0 & 0 & 0 \\ 0 & 0 & 0 & 0 \end{bmatrix}\begin{pmatrix} \theta \\ x \\ X_3 \\ X_4 \end{pmatrix} = \begin{pmatrix} M \\ F \\ F_3 \\ F_4 \end{pmatrix} - [K']\begin{pmatrix} \theta \\ x \\ X_3 \\ X_4 \end{pmatrix} \tag{18}$$

$$\Rightarrow \begin{bmatrix} I & 0 & 0 & 0 \\ 0 & m & 0 & 0 \\ 0 & 0 & m_a & 0 \\ 0 & 0 & 0 & m_a \end{bmatrix}\begin{pmatrix} \ddot{\theta} \\ \ddot{x} \\ \ddot{X}_3 \\ \ddot{X}_4 \end{pmatrix} + \left\{\begin{bmatrix} k_t & 0 & 0 & 0 \\ 0 & k & 0 & 0 \\ 0 & 0 & 0 & 0 \\ 0 & 0 & 0 & 0 \end{bmatrix} + [K']\right\}\begin{pmatrix} \theta \\ x \\ X_3 \\ X_4 \end{pmatrix} = \begin{pmatrix} M \\ F \\ F_3 \\ F_4 \end{pmatrix}$$

It is important to note that the coupling between the coordinates in Equation (18) is due to the matrix [K']. Evaluating the elements of [K'] from equations (4) and (17), the governing equation for the rotation, θ, of the diaphragm is:

$$I\ddot{\theta} + \left(k_t + \left(\frac{d}{2}\right)^2(k_{11} - k_{12} - k_{21} + k_{22})\right)\theta + \left(\frac{d}{2}\right)(k_{11} + k_{12} - k_{21} - k_{22})x + \left(\frac{d}{2}\right)(k_{13} - k_{23})X_3 + \left(\frac{d}{2}\right)(k_{14} - k_{24})X_4 = M \tag{19}$$

where:

$$K_{ij} = -\frac{\rho_0 c^2}{V}A_iA_j.$$

Note that if the diaphragm is symmetric, $A_1 = A_2$, and $A_3 = A_4$. As a result, the coefficients of x, $X_3$, and $X_4$ in equation (19) become zero. This causes the governing equation for rotation to be independent of the other coordinates as well as independent of the volume, V (i.e., $I\ddot{\theta} + k_t\theta = M$). The rotation is also independent of the area of the slits 114, because of the assumption that the pressure created within the back volume 108 is spatially uniform and therefore does not create any net moment on the diaphragm 102.

In the foregoing analysis, it has been assumed that the microphone diaphragm 102 is symmetric about the central pivot point 106. As mentioned above, in this case, the diaphragm 102 behaves like a differential microphone diaphragm and has a first-order directional response. If, however, the diaphragm 102 is designed to be asymmetrical with respect to pivot point 106, then the directionality departs from that of a differential microphone and tends toward that of a nondirectional microphone. The effect of the back volume 108 on the rotation of the diaphragm 102 can be determined by extending the foregoing analysis to this non-symmetric case.

Figure 5:
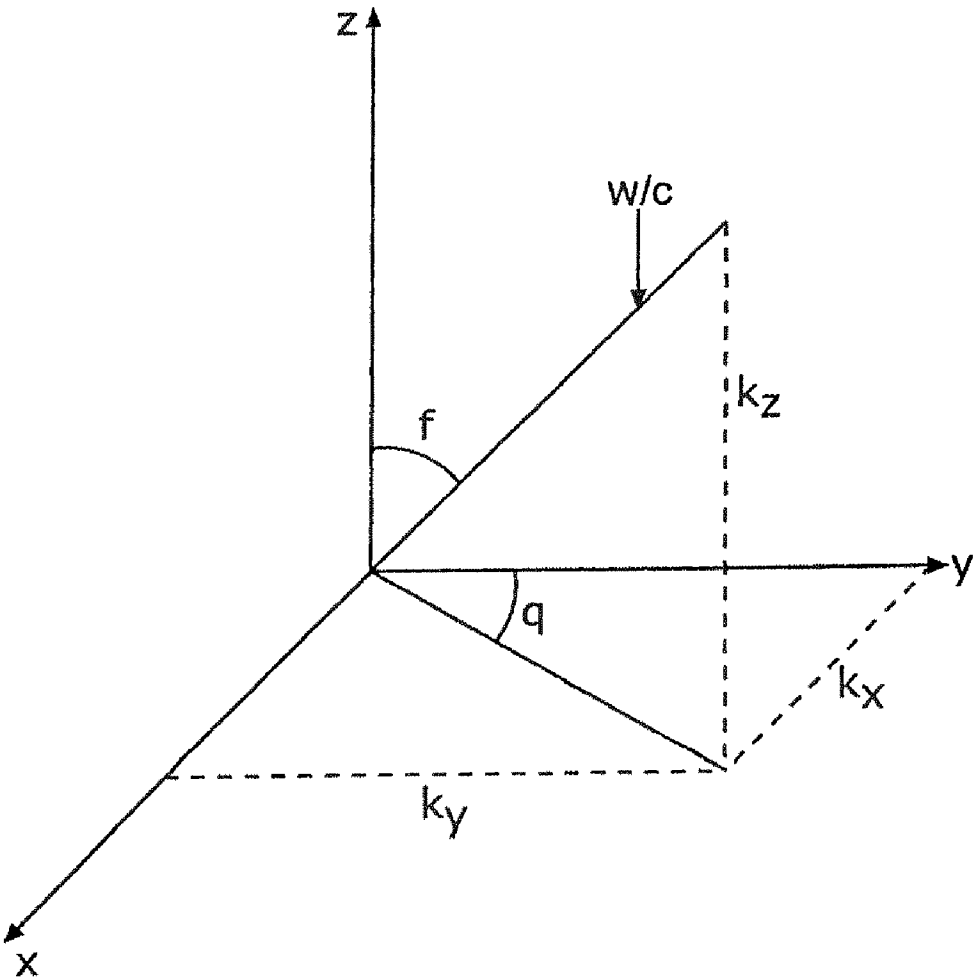
FIG. 5 is a diagram showing the orientation of an incident sound wave on the diaphragm of FIG. 1.

In the following, expressions are derived for the forces and moment that are applied to the microphone diaphragm 102 due to an acoustic plane wave. For plane waves, the pressure acting on the diaphragm 102 is assumed to be of the form $p=Pe^{i\omega t}e^{(-\hat{i}k_x x-\hat{i}k_y y)}$, where $$k_x = \frac{\omega}{c}\sin\phi\sin\theta,$$

$$k_y = \frac{\omega}{c}\sin\phi\cos\theta$$

and $$k_z = \frac{\omega}{c}\cos\phi,$$

where the angles are defined in FIG. 5. The net moment due to the incident sound is given by $$M = \int_{-L_x/2}^{L_x/2}\int_{-L_y/2}^{L_y/2} Pe^{\hat{i}\omega t}e^{(-\hat{i}k_x x-\hat{i}k_y y)}x\,dx\,dy$$

where $L_x$ and $L_y$ are the lengths in the x and y directions, respectively.

The expression for the moment can be integrated separately over the x and y directions to give $$\Rightarrow M = Pe^{\hat{i}\omega t}\int_{-L_x/2}^{L_x/2} e^{-\hat{i}k_x x}x\,dx\int_{-L_y/2}^{L_y/2} e^{-\hat{i}k_y y}\,dy.$$

Integrating over the y coordinate becomes $$\Rightarrow M = Pe^{\hat{i}\omega t}\frac{\left(e^{\hat{i}k_y L_y/2} - e^{\hat{i}k_y L_y/2}\right.}{-\hat{i}k_y}\int_{-L_x/2}^{L_x/2} e^{-\hat{i}k_x x}x\,dx \Rightarrow M =$$

$$Pe^{\hat{i}\omega t}\frac{2\sin\left(\frac{k_y L_y}{2}\right.}{}\int_{-L_x/2}^{L_x/2} e^{-\hat{i}k_x x}x\,dx.$$

Integrating by parts for the x-component gives:

$$\Rightarrow M = Pe^{\hat{i}\omega t}\frac{2\sin\left(\frac{k_y L_y}{2}\right)}{k_y}\left[\frac{L_x}{2}\frac{\left(e^{-\hat{i}k_x L_x/2} + e^{\hat{i}k_x L_x/2}\right)}{-\hat{i}k_x} + \frac{1}{k_x^2}\left(e^{\hat{i}k_x L_x/2} + e^{-\hat{i}k_x L_x/2}\right)\right].$$

Simplifying the above gives:

$$\Rightarrow M = Pe^{\hat{i}\omega t}\left[\frac{2\sin\left(\frac{k_y L_y}{2}\right)}{k_y}\right]\left[\frac{-L_x}{\hat{i}k_x}\cos\left(\frac{k_x L_x}{2}\right) - \frac{2\hat{i}}{k_x^2}\sin\left(\frac{k_x L_x}{2}\right)\right] \tag{20}$$

Because the dimensions of the diaphragm are very small relative to the wavelength of sound, the arguments of the sin and cosine functions are very small, which results in $$\sin\left(\frac{k_y L_y}{2}\right) \approx \frac{k_y L_y}{2}.$$

The second term in brackets in Equation (20) is expanded to second order using Taylor's series. Using $$\cos\theta \approx 1 - \frac{\theta^2}{2} \text{ and } \sin\theta \approx \theta - \frac{\theta^3}{6},$$

in Equation (16), $$M \approx Pe^{\hat{i}\omega t}\left[2\left(\frac{L_y}{2}\right)\right]\left[\frac{-L_x}{\hat{i}k_x}\left(1 - \frac{k_x^2 L_x^2}{8}\right) - \frac{2\hat{i}}{k_x^2}\left(\frac{k_x L_x}{2} - \frac{k_x^3 L_x^3}{48}\right)\right].$$

Simplifying gives:

$$M \approx Pe^{\hat{i}\omega t}L_y\frac{k_x L_x^3}{12\hat{i}} \tag{21}$$

The net force is given by a surface integral of the acoustic pressure, $$F = -\int_{-L_x/2}^{L_x/2}\int_{-L_y/2}^{L_y/2} Pe^{\hat{i}\omega t}e^{-\hat{i}k_x x - -\hat{i}k_y y}\,dx\,dy.$$

Carrying out the integration gives:

$$F - -Pe^{\hat{i}\omega t}\frac{2\sin\left(\frac{k_x L_x}{2}\right)}{k_x}\frac{2\sin\left(\frac{k_y L_y}{2}\right)}{k_y}.$$

Again, for small angles this becomes $$F = -Pe^{\hat{i}\omega t}(L_x L_y) \tag{22}$$

Using Equations (15), (18) and (19):

$$\begin{bmatrix} I & 0 & 0 & 0 \\ 0 & m & 0 & 0 \\ 0 & 0 & m_a & 0 \\ 0 & 0 & 0 & m_a \end{bmatrix} \begin{pmatrix} \ddot{\theta} \\ \ddot{x} \\ \ddot{X}_3 \\ \ddot{X}_4 \end{pmatrix} + \left\{ \begin{bmatrix} k_t & 0 & 0 & 0 \\ 0 & k & 0 & 0 \\ 0 & 0 & 0 & 0 \\ 0 & 0 & 0 & 0 \end{bmatrix} + [K'] \right\} \begin{pmatrix} \theta \\ x \\ X_3 \\ X_4 \end{pmatrix} = \begin{pmatrix} Pe^{i\omega t} L_y \frac{k_x L_x^3}{12\hat{\ell}} \\ -Pe^{i\omega t}(L_x L_y) \\ -PA_a \\ -PA_a \end{pmatrix}$$

Let $$K_{eq} = \left\{ \begin{bmatrix} k_t & 0 & 0 & 0 \\ 0 & k & 0 & 0 \\ 0 & 0 & 0 & 0 \\ 0 & 0 & 0 & 0 \end{bmatrix} + [K'] \right\}$$

and assume $\theta=\Theta e^{i\omega t}$, $x=Xe^{i\omega t}$, $X_3=X_3e^{i\omega t}$ and $$X_4 = X_4 e^{i\omega t} \Rightarrow \tag{23}$$

$$\begin{bmatrix} K_{eq}(1,1) - I\omega^2 & K_{eq}(1,2) & K_{eq}(1,3) & K_{eq}(1,4) \\ K_{eq}(2,1) & K_{eq}(2,2) - m\omega^2 & K_{eq}(2,3) & K_{eq}(2,4) \\ K_{eq}(3,1) & K_{eq}(3,2) & K_{eq}(3,3) - m_a\omega^2 & K_{eq}(3,4) \\ K_{eq}(4,1) & K_{eq}(4,2) & K_{eq}(4,3) & K_{eq}(4,4) - m_a\omega^2 \end{bmatrix}$$

$$\begin{pmatrix} \Theta/P \\ X/P \\ X_3/P \\ X_4/P \end{pmatrix} = \begin{pmatrix} L_y \frac{k_x L_x^3}{12\hat{\ell}} \\ -(L_x L_y) \\ -A_a \\ -A_a \end{pmatrix}$$

Using Equation (23), the displacement and rotation relative to the amplitude of the pressure, X/P and θ/P, as a function of the excitation frequency, ω may be computed.

Based on the foregoing analysis, it may be observed that if the air in the back volume 108 is considered to be in viscid, the performance of the differential microphone diaphragm 102 is not degraded if the depth of the backing cavity 110 is reduced significantly. Thus the microphone 100 can be fabricated without the need for a backside hole behind the diaphragm 102. The fabrication process for the surface micromachined microphone diaphragm is shown in FIGS. 6*a*-6*d*.

Figure 6A:
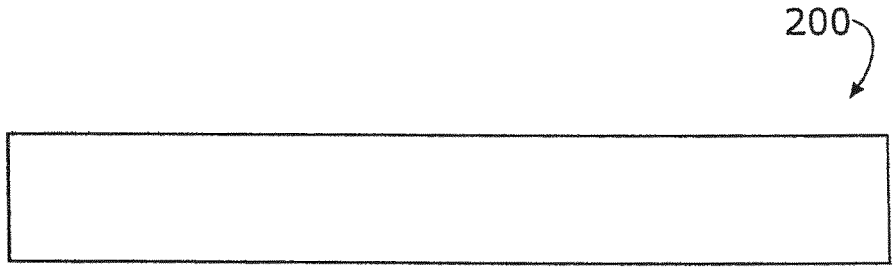
FIGS. 6*a*-6*d* are schematic representations of the stages of fabrication of the inventive, surface micromachined microphone of the invention.

Referring now to FIG. 6*a*, there is shown a bare silicon wafer 200 before fabrication is begun. Such silicon wafers are known to those skilled in the art and are not further described herein.

Figure 6B:
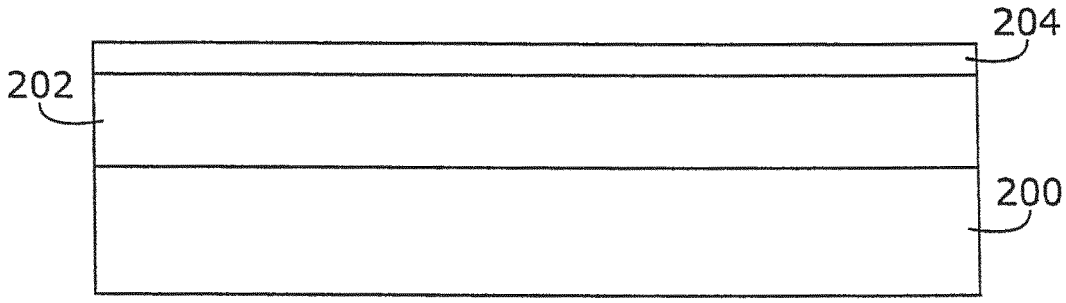

As may be seen in FIG. 6*b*, a sacrificial layer (e.g., silicon dioxide) 202 is deposited on an upper surface of wafer 200. While silicon dioxide has been found suitable for forming sacrificial layer 202, many other suitable material are know to those of skill in the art. For example, low temperature oxide (LTO), phosphosilicate glass (PSG), aluminum are known to be suitable. Likewise, photoresist material may be used. In still other embodiments, polymeric materials may be used to form sacrificial layer 202. It will be recognized that other suitable material may exist. The choice and use of such material is considered to be known to those of skill in the art and is not further described herein. Consequently, the invention is not considered limited to a specific sacrificial layer material. Rather, the invention covers any suitable material used to form a sacrificial layer in accordance with the inventive method.

Over sacrificial layer 202, a layer of structural material (for example polysilicon) is also deposited. While polysilicon has been found suitable for the formation of layer 204, it will be recognized that layer 204 may be formed from other materials. For example, silicon nitride, gold, aluminum, copper or other material having similar characteristic may be used. Consequently, the invention is not limited to the specific material chosen for purposes of disclosure but covers any and all similar, suitable material. Layer 204 will ultimately form diaphragm 102 (FIG. 2).

Figure 6C:
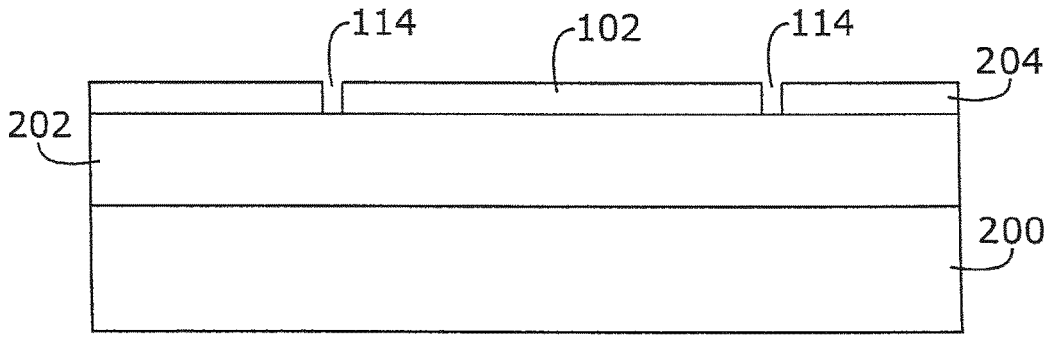

As is shown in FIG. 6*c*, the diaphragm material, layer 204 is next patterned and etched to form the diaphragm 102, leaving slits 114.

Figure 6D:
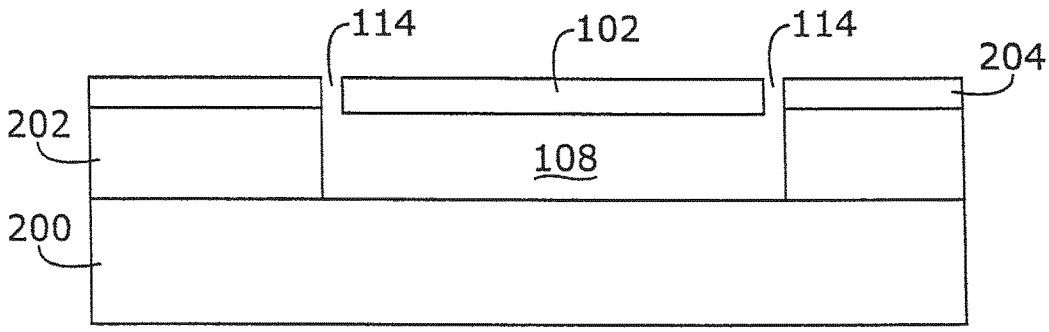

Finally, as may be seen in FIG. 6*d*, the sacrificial layer 202 under diaphragm 102 is removed leaving cavity 110. After the removal of the sacrificial layer, the microphone diaphragm 102 has a back volume 108 with a depth equal to the thickness of the sacrificial layer 202. The microphone is shown schematically in FIG. 7.

To convert motion of diaphragm 102 into an electronic signal, comb fingers incorporated at 208 (FIG. 7) may be integrated with the diaphragm. Such comb or interdigitated fingers are described in detail in copending U.S. patent application Ser. No. 11/198,370 for COMB SENSE MICROPHONE, filed Aug. 5, 2005.

Figure 7:
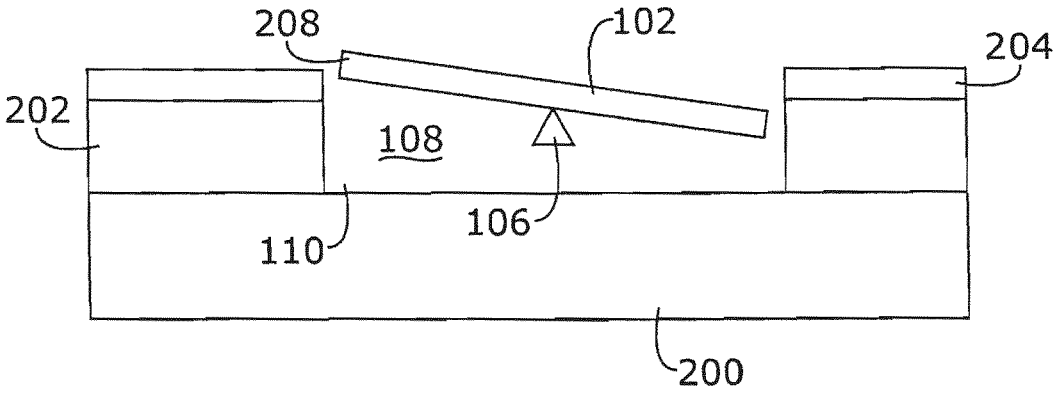
FIG. 7 is a side, sectional, schematic view of a differential microphone formed by removing a portion of a sacrificial layer of FIG. 6*d*.
Figure 8:
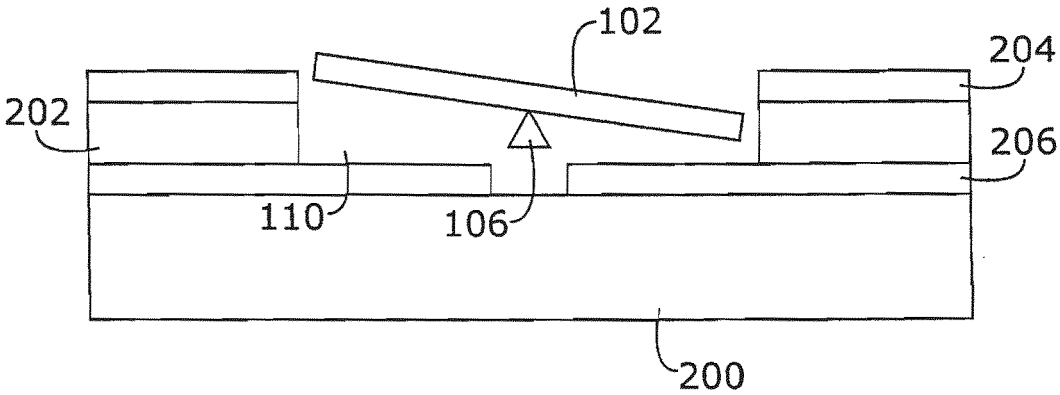
FIG. 8 is a side, sectional, schematic view of an alternate embodiment of the microphone of FIG. 2.

As an alternative sensing scheme, the fundamental microphone structure of FIG. 7 may be modified slightly to include two conductive layers 206 disposed between silicon chip 200 and additional conductive layer 204 to form back plates forming fixed electrodes of capacitors. These back plates are electrically separated from each other in order to allow differential capacitive sensing of the diaphragm motion.

It should be noted that one could employ both the comb fingers 208 and the back plate 206 to perform capacitive sensing. In this case, in addition to serving as an element of a capacitive sensing arrangement, a voltage applied to comb sense fingers 208 may be used to stabilize diaphragm 102. The voltage applied between the comb fingers and the diaphragm can be used to reduce the effect of the collapse voltage, which is a common design issue in conventional back plate-based capacitive sensing schemes.

It will be recognized that many other sensing arrangements may be used to convert motion of diaphragm 102 to an electrical signal. Consequently, the invention is not limited to any particular diaphragm motion sensing arrangement.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

The invention claimed is:

1. A method of forming a miniature, surface micromachined, differential microphone, comprising:

depositing a sacrificial layer on a top surface of a silicon wafer;

depositing a diaphragm material layer on an upper surface of said sacrificial layer;

etching said diaphragm material layer to isolate a diaphragm therein by forming a slit defining a perimeter of said diaphragm and a supporting hinge" wherein said diaphragm is responsive to displace about an axis of rotational movement, in response to an acoustic wave which induces a torque about the supporting hinge; and removing at least a portion of said sacrificial layer from a region beneath said isolated diaphragm wherein a displacement of the diaphragm is transduced to a signal by at least one structure.

2. The method according to claim 1, wherein said etching further comprises forming comb sense fingers along at least a portion of the perimeter of said diaphragm.

3. The method according to claim 1, further comprising forming a conductive layer intermediate said top surface of said silicon wafer and said sacrificial layer.

4. The method according to claim 1, wherein said depositing the sacrificial layer comprises depositing a layer of at least one material selected from the group consisting of silicon dioxide, low temperature oxide (LTO), phosphosilicate glass (PSG), aluminum, photoresist material, and a polymeric material.

5. The method according to claim 1, wherein said depositing the diaphragm material layer comprises depositing a layer of at least one material selected from the group consisting of polysilicon, silicon nitride, gold, aluminum, and copper.

6. The method according to claim 1, further comprising depositing a conductive material on the diaphragm material layer, configured to serve as an electrode for sensing an acoustic vibration of the diaphragm.

7. The method according to claim 1, wherein the diaphragm is isolated from a remaining portion of said diaphragm material layer after etching and removing, by the slit, and another portion comprising the supporting hinge attaching the diaphragm to the remaining portion of the diaphragm material layer.

8. The method according to claim 7, wherein an enclosed back volume is formed beneath said diaphragm having a depth defined by a thickness of said sacrificial layer, said back volume communicating with a region external thereto only via said slit.

9. The method according to claim 8, further comprising forming a plurality of comb sense fingers disposed along at least a portion of the perimeter of said diaphragm.

10. The method according to claim 1, further comprising depositing a conductive layer intermediate said top surface of said silicon wafer and a lower surface of said sacrificial layer.

11. The method according to claim 1, wherein said etching comprises forming the slit as a narrow gap around a portion of the diaphragm to separate the diaphragm from a remaining portion of the diaphragm material layer, the slit being configured to define corresponding sets of comb sense fingers on the diaphragm and the remaining portion of the diaphragm material layer, and maintaining the supporting hinge as a portion bridging the diaphragm and the remaining portion of the diaphragm material layer which is configured to act as a resilient hinge, wherein the diaphragm moves in response to acoustic vibration about the resilient hinge, further comprising providing respectively isolated electrodes on the corresponding sets of comb sense fingers for capacitive sensing of the diaphragm movement.

12. The method according to claim 1, wherein said removing defines an enclosed back volume for the diaphragm.

13. A method, comprising:

depositing a sacrificial layer on an upper surface of a silicon wafer;

depositing a diaphragm material on an upper surface of said sacrificial layer;

etching said diaphragm material layer to isolate a diaphragm therein by forming a slit defining a plurality of comb sense fingers along at least a portion of a perimeter of said diaphragm and a supporting hinge;

removing at least a portion of said sacrificial layer from a region beneath said diaphragm to form a back volume;

forming a hole through the silicon wafer or a remaining portion of the sacrificial layer allowing fluidic communication between the back volume and a region external thereto.

14. The method according to claim 13, further comprising forming a conductive layer intermediate said upper surface of said silicon wafer and said sacrificial layer.

15. The method according to claim 13, wherein said depositing the sacrificial layer comprises depositing a layer of at least one material selected from the group consisting of silicon dioxide, low temperature oxide (LTO), phosphosilicate glass (PSG), aluminum, photoresist material, and a polymeric material.

16. The method according to claim 13, wherein said depositing the diaphragm material layer comprises depositing a layer of at least one material selected from the group consisting of polysilicon, silicon nitride, gold, aluminum, and copper.

17. A method, comprising:

depositing on a surface of a substrate a sacrificial layer, and a diaphragm layer disposed on top of said sacrificial layer;

forming an aperture through said diaphragm layer resulting in at least one support;

removing at least a portion of said sacrificial layer beneath the diaphragm layer, resulting in a pivotally supported diaphragm with a void between said diaphragm layer and said substrate maintained over the void by the at least one support, wherein said diaphragm has an axis of rotational movement in response to a torque about the at least one support; and forming a plurality of comb sense fingers disposed along at least a portion of a perimeter of said diaphragm as a transducer for producing an electrical signal responsive to a displacement of said diaphragm with respect to said substrate due to an acoustic force exerting the torque on the diaphragm.

18. The method according to claim 17, wherein said axis of rotational movement is located such that said diaphragm has a directional response to an acoustic wave.

19. The method according to claim 18, wherein a volume beneath said diaphragm is substantially constant with respect to the rotational movement in response to the acoustic force.

20. The method according to claim 17, wherein the void beneath said diaphragm has a depth approximately the same as a thickness of said sacrificial layer.

21. The method according to claim 17, wherein said axis is located such that said diaphragm has a directional response to an acoustic force, and wherein a volume of the void beneath said diaphragm is substantially constant with respect to movements in response to the acoustic force, said aperture comprising a slit permitting air flow therethrough, and a moment M acting on one side of said diaphragm with respect to said axis, in response to the acoustic force produced by an acoustic wave having a wavelength larger than a maximum linear dimension of said void, over a small angle of deflection, is approximately:

$$M = Pe^{i\omega t} L_y \frac{k_x L_x^3}{12\hat{l}}$$

in which:

$L_y$ is a dimension of the diaphragm along said axis, $L_x$ is a dimension of the diaphragm perpendicular to, and measured from said axis in a plane of the diaphragm, P represents an amplitude of the acoustic wave, ω represents a frequency of the acoustic wave, c represents a velocity of the acoustic wave, $k_x=(\omega/c)\sin\phi\sin\theta$, ϕ is the angle between a plane of the diaphragm and the propagation of the acoustic wave, and θ is the angle of propagation of the acoustic wave projected onto the plane of the diaphragm.

* * * * *

UNITED STATES PATENT AND TRADEMARK OFFICE

CERTIFICATE OF CORRECTION

PATENT NO. : 8,214,999 B2
APPLICATION NO. : 13/198113
DATED : July 10, 2012
INVENTOR(S) : Ronald N. Miles It is certified that error appears in the above-identified patent and that said Letters Patent is hereby corrected as shown below:

In the Claims:

Col. 11, line 19 please replace “”” with -- , --

Signed and Sealed this
Twenty-first Day of May, 2013

Teresa Stanek Rea
*Acting Director of the United States Patent and Trademark Office*